US007316540B2

(12) United States Patent
Russak et al.

(10) Patent No.: US 7,316,540 B2
(45) Date of Patent: Jan. 8, 2008

(54) ROTATABLE PIVOT MOUNT FOR FANS AND OTHER APPLIANCES

(75) Inventors: Stephen Russak, Demarest, NJ (US); Anthony DeMore, New York, NY (US); Steven Vordenberg, New York, NY (US); Anthony Lai, Burlington, MA (US); Robert Rizzari, Billerica, MA (US); David Bossa, New York, NY (US); Simon Huang, New York, NY (US); Peachen Qui, New York, NY (US)

(73) Assignee: Kaz, Incorporated, New York, NY (US)

( * ) Notice: Subject to any disclaimer, the term of this patent is extended or adjusted under 35 U.S.C. 154(b) by 214 days.

(21) Appl. No.: 11/334,945

(22) Filed: Jan. 18, 2006

(65) Prior Publication Data

US 2007/0166160 A1 Jul. 19, 2007

(51) Int. Cl.
*F04D 25/48* (2006.01)

(52) U.S. Cl. ..... 416/63; 416/205; 248/125.7

(58) Field of Classification Search ..... 416/63, 416/205, 244 R; 248/125.7, 130, 676
See application file for complete search history.

(56) References Cited

U.S. PATENT DOCUMENTS

| | | | | |
|---|---|---|---|---|
| 2,117,310 | A | | 5/1938 | Garrott |
| 2,123,448 | A | | 7/1938 | Weber |
| 2,667,301 | A | | 1/1954 | Lautner |
| 3,204,898 | A | * | 9/1965 | Manning ..... 248/516 |
| 4,533,105 | A | * | 8/1985 | Cornwell et al. ..... 248/371 |
| 4,645,153 | A | * | 2/1987 | Granzow et al. ..... 248/181.2 |
| 5,368,445 | A | | 11/1994 | Litvin et al. |
| 5,431,544 | A | | 7/1995 | Hsu et al. |
| 5,480,282 | A | | 1/1996 | Matson |
| 5,609,473 | A | | 3/1997 | Litvin |
| 2005/0232753 | A1 | | 10/2005 | Hopkins |

* cited by examiner

*Primary Examiner*—Edward K. Look
*Assistant Examiner*—Dwayne J White
(74) *Attorney, Agent, or Firm*—Darby & Darby

(57) ABSTRACT

A pivot assembly that can be used with various appliances. The pivot assembly provides up to three degrees of freedom when positioning the appliance. The pivot may be used, for example, with a fan that is mounted on a base such that direction of the airflow generated can be adjusted about three coordinate axes by manipulating a single rotatable pivot mount. The fan assembly includes a base unit and an arm to which an appliance may be detachably coupled. The opposite end of the arm is provided with a spherical cap which is received by the base unit. Any adjustments to the positioning of the rotatable pivot mount are maintained by the friction within the rotatable pivot mount. Additionally, the pivot mount may include a pivot guide to restrict the degree of rotation about the pivot, thereby increasing stability.

19 Claims, 2 Drawing Sheets

ROTATABLE PIVOT MOUNT FOR FANS AND OTHER APPLIANCES

FIELD OF THE INVENTION

The invention relates to an assembly of the type which can be positioned to change the direction of an appliance in the horizontal and vertical directions.

BACKGROUND OF THE INVENTION

Directionally adjustable fans have long been known. Such fans are useful when it is desirable to direct the airflow from the fan in a specific direction without moving the base of the fan.

Directionally adjustable fans that are capable of pivoting about both the vertical axis and the horizontal axis are typically designed with two pivot mechanisms—one for each axis. One type of pivot mechanism which allows adjustment of the vertical direction of the airflow includes coupling the fan assembly to rotatable mounts at each of the two ends of the diameter of the fan assembly forming an axis of rotation that is parallel to the floor of the base of the fan. Alternatively, the fan assembly is coupled to an arm which is rotatably mounted to the base, thereby allowing the fan to rotate about the horizontal axis defined by the rotatable mount. The horizontal direction of the airflow is adjusted by coupling the fan to the base through a mounting that is rotatable about the vertical axis. According to either design, adjusting the direction of airflow from the fan in both the vertical and horizontal axis requires the separate adjustment of two rotatable mountings.

Once the fan is adjusted so that the airflow generated flows in the desired direction, a mechanism is typically employed to preserve the adjustments in the event an external force is applied to the fan that would alter the position of the fan. Typically, the angular adjustments made to the fan are maintained by friction within the rotatable mount. Another way of preserving the angular adjustments is by tightening a screw coupled to each rotatable mount to increase the friction. Additionally, the screw could be loosened to allow adjustments to be made more easily. These frictional forces may be further increased by employing a gear structure of radially extending teeth between the mounting contact surfaces. However, the gear teeth decrease the precision of the adjustments since the teeth must properly mesh at predefined positions. Also, the gears increase the difficulty in making the adjustments since the mount surfaces no longer smoothly glide as the mounting is rotated.

Similar mounting devices have been provided for other appliances in addition to fans. Space heaters have been rotatably mounted to allow for adjusting the direction of the heat. Mirrors are frequently attached to a table stand and provide two or more rotatable mountings so that the mirror can be adjusted about the vertical and horizontal axis. Rotatable mirror mountings can also be fixed to a wall by an extendable arm, thereby allowing the mirror to be pulled away from the wall and rotatably adjusted.

SUMMARY OF THE INVENTION

The present invention is directed to a pivot assembly that can be used with various appliances. The pivot assembly provides three degrees of freedom when positioning the appliance. The pivot may be used, for example, with a fan that is mounted on a base such that the direction of the airflow generated can be adjusted about all three coordinate axes by manipulating a single rotatable pivot mount. Any adjustments to the positioning of the rotatable pivot mount are maintained by the friction within the rotatable pivot mount. The ability to direct airflow through the manipulation of a single rotatable pivot mount provides a fast adjustment and allows for more accurate airflow direction.

The fan assembly includes a base unit and an arm. The arm includes a mounting end to which the blower unit of the fan is detachably coupled. The opposite end of the arm is provided with a spherical cap which is received by the base unit. The base unit includes a bottom portion and a top portion. The top portion includes an opening through which the arm extends. The opening of the top portion is smaller than the diameter of the spherical cap of the arm thereby preventing the arm from being unintentionally detached from the base. The opening is shaped such that it is substantially flush with the outer surface of the spherical cap. The bottom portion of the base unit exerts a force against the spherical cap such that the friction between the spherical cap of the arm and the top portion of the base will maintain the positional adjustment made to the arm.

In another embodiment of this invention the force exerted by the bottom portion of the base against the spherical cap of the arm is transmitted through a spherical cap mount. The spherical cap mount has an outer radius roughly equal to the inner radius of the spherical cap of the arm, such that the bottom of the spherical cap of the arm rests substantially flush against the outer surface of the spherical cap mount as the arm pivots and rotates. A force can be created by tightening the coupling of the top potion of the base unit and the bottom portion of the base unit so that the spherical cap of the arm is held tightly in between. Preferably, the force is created by including a spring in the bottom portion of the base unit which exerts the force against the spherical cap of the arm directly or transmits the force through the spherical cap mount.

In another embodiment of the invention the arm is extendable thereby providing an additional way to adjust the direction of the airflow. The arm may be of a telescoping type and provided with a locking mechanism for each segment of the telescoping arm.

The fan blower may include a handle coupled to the blower by which the rotatable pivot mount may be adjusted and the fan direction altered. The handle should be positioned so that it will act as a lever when rotating the fan about any axis, thereby reducing the amount of force required to overcome the friction force created within the rotatable pivot mount.

In another embodiment of this invention the opening of the top portion of the base unit can act as a pivot guide for positioning the arm by preventing the fan from being adjusted to certain positions. If the fan is pivoted too far off the vertical axis, the center of gravity may extend beyond the support area provided by the base and the fan may become unstable and topple over. The shape of the pivot guide can be adjusted to prevent the fan from pivoting to a position where the center of gravity of the fan extends beyond the support area provided by the base.

The pivot guide also provides increased stability of the fan when adjusted to certain positions. The pivot guide can provide inlets in which the arm rests, thus complementing the support provided by the frictional force exerted by the bottom potion of the base unit. Thus, while the arm is positioned in one of the inlets provided by the pivot guide, if the assembly is disturbed by an external force, the added stability decreases the likelihood of the fan being moved out of position.

Additionally, the pivot guide may be detachable from the base unit, thus making the shape of the top portion opening modifiable. Because the shape of the opening serves a decorative purpose as well as the functional purpose described above, the decorative element can be enhanced by allowing a user to select a pivot guide to match any desired esthetic or visual appearance.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF PREFERRED EMBODIMENTS

Figure 1:
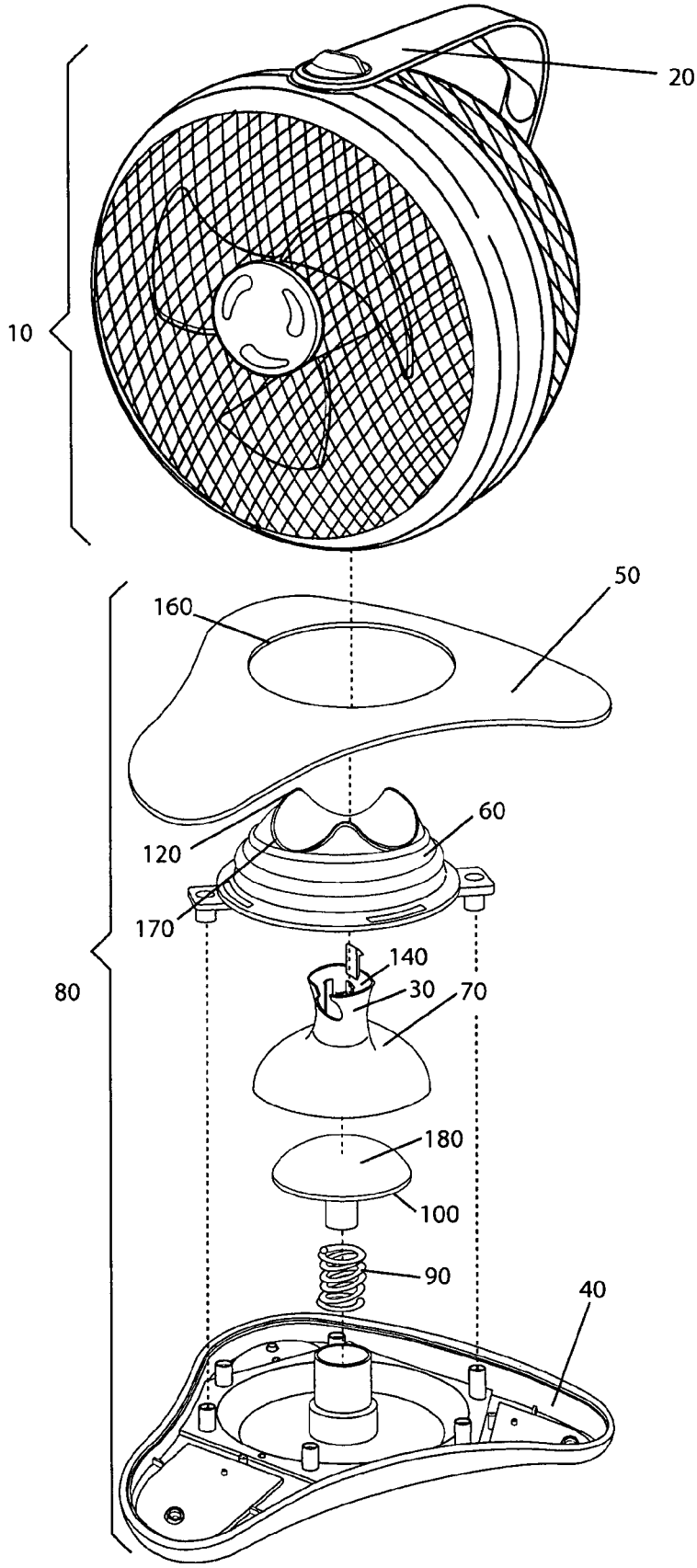
FIG. 1 is an exploded top front perspective view of a first embodiment of the invention.

Referring now to the drawings the present invention is directed to a pivot mount assembly. The pivot may be used with almost any appliance, including a mirror, fan, or heater. By way of illustration, the pivot mount is discussed in conjunction with a fan assembly that allows the airflow generated to be adjusted along three axes by manipulating a single rotatable pivot mount. Any adjustments to the positioning of the rotatable pivot mount are maintained by the continuous friction at the rotatable pivot mount. The ability to direct airflow in one or more dimensions through the manipulation of a single rotatable pivot mount provides a fast adjustment and allows for more accurate airflow direction.

Figure 2:
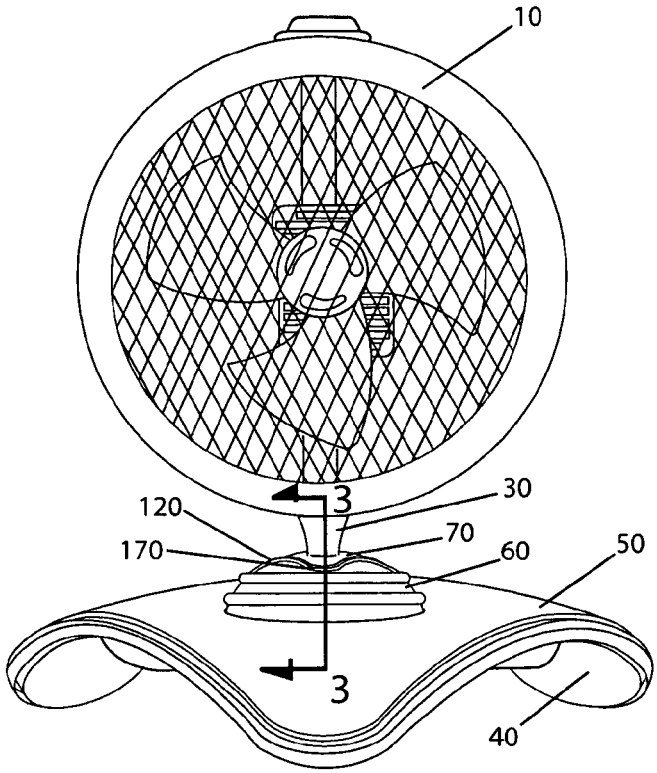
FIG. 2 is a front elevation view of the first embodiment of the invention.
Figure 3:
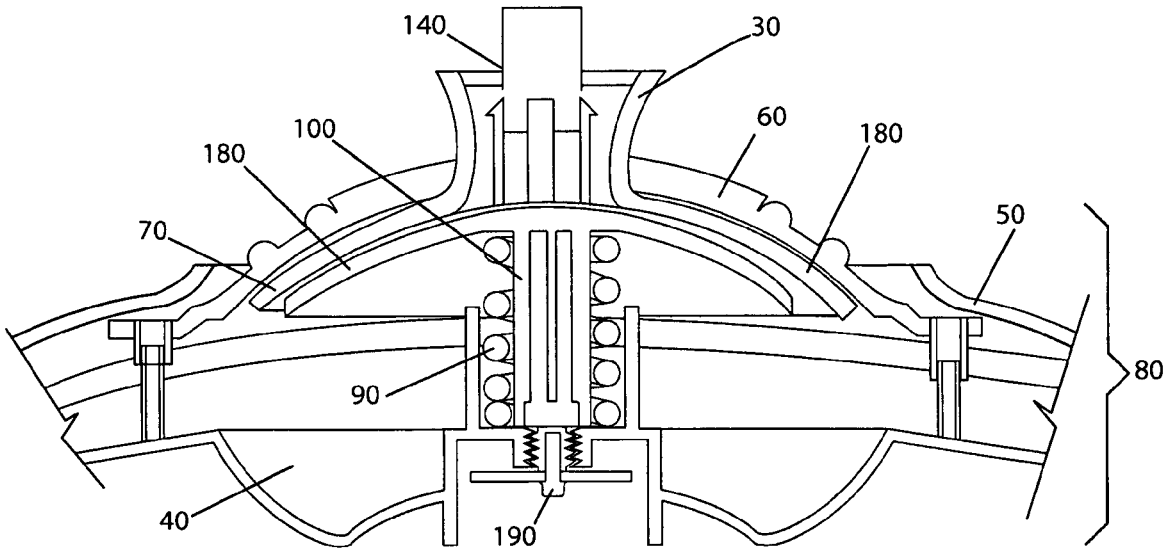
FIG. 3 is a cross section view of the front view of FIG. 2.

Referring now to FIGS. 1-3, the fan assembly includes a base unit 80 and an arm 30. The arm 30 includes a pivot end having a spherical cap 70 and a receiving end 140 to which the blower 10 can be detachably coupled. An axis of the arm is defined by the pivot end and the receiving end 140. The spherical cap 70 of the pivot end of the arm 30 has an inner radius, an outer radius, and a diameter 180. The spherical cap 70 is received by the base unit 80. The base unit 80 includes a bottom portion 40 and a top portion 50 coupled to the bottom portion 40. It is further contemplated that the top portion 50 can be connected to the bottom portion 40 indirectly through another fixture interposed between the top portion 50 and bottom portion 40.

The top portion 50 of the base unit 80 includes an opening 160 through which the arm 30 extends. The opening 160 of the top portion 50 is smaller than the diameter 180 of the spherical cap 70 of the arm 30 thereby preventing the arm from being unintentionally removed from the base 80. Additionally, the opening 160 is shaped such that it is substantially flush with the outer surface of the spherical cap 70.

Alternatively, the top portion 50 may include a pivot guide 60 through which the arm 30 extends. The pivot guide 60 is coupled to the top portion 50 of the base unit 80, and the opening 120 of the pivot guide 60 is smaller than the diameter 180 of the spherical cap 70 of the arm 30. The opening 120 of the pivot guide is shaped such that it is substantially flush with the outer surface of the spherical cap 70.

The pivot guide 60 is preferably detachable from the top portion 50, so that the shape of the opening 120 can be modified by replacing the pivot guide 60. Alternatively, the opening 160 of the top portion 50 may be molded to form the pivot guide 60. The embodiment in FIG. 3 demonstrates that the pivot guide 60 can be coupled to the top portion shell 150, from within the base unit 80. Alternatively, the pivot guide 60 may be coupled to the top portion shell 150 from the exterior of the base unit 80 to facilitate the replacement of the pivot guide 60. In a preferred embodiment the shape of the pivot guide 60 substantially conforms to the surface of a sphere having a radius roughly equal to the outer radius of the spherical cap 70 of the arm such that the outer surface of the spherical cap 70 of the arm is substantially flush with the inner surface of the pivot guide 60 as the arm 30 is positioned on the rotatable pivot mount. Because the shape of the opening 120 of the pivot guide 60 serves a decorative purpose as well as the functional purpose described above, the decorative aspect can be enhanced by allowing a user to select a pivot guide to match the desired esthetic or visual appearance.

The bottom portion 40 of the base unit 80 holds the spherical cap 70 of the arm 30 between the base unit 80 and the top portion 50 such that the outer surface of the spherical cap 70 will remain substantially flush with opening 120 of the top portion 50 of the base unit 80. By tightly holding the spherical cap 70 of the arm 30, the bottom portion 40 creates a friction force within the rotatable pivot mount that will statically maintain the position of the arm 30 as the axis of the arm is rotated into a selected orientation and angularly rotated about the selected orientation.

In one embodiment, the bottom portion 40 of the base unit 80 includes a spherical cap mount 100 which transmits a force against the spherical cap 70 of the arm 30. The spherical cap mount 100 has an outer radius roughly equal to the inner radius of the spherical cap 70 of the arm 30, such that when it is disposed within the bottom of the spherical cap 70 of the arm 30, the outer surface of the spherical cap mount 100 rests substantially flush against the inner surface of the spherical cap 70 of the arm 30 as it pivots and rotates.

The frictional force created within the rotatable pivot mount can be increased or decreased by tightening or loosening the connection between the top portion 50 and the bottom portion 40 of the base unit 80 so that the force which presses the spherical cap 70 of the arm 30 within the base unit 80 is varied. In the embodiment shown in FIG. 3 the frictional force is created in part by a spring 90 in the bottom portion 40 of the base unit 80 which exerts a force against the spherical cap 70 of the arm 30, through the spherical cap mount 100, and against the top portion 50. Alternatively, the force can be transmitted through multiple springs or couplings.

It is further contemplated that the spherical cap mount 100 may be coupled to the bottom portion 40 of the base unit 80 by a threaded connection allowing the vertical height of the spherical cap mount 100 to be adjusted by rotating the spherical cap mount 100, thereby adjusting the frictional force maintaining the static position of the arm 30. Alternatively, the force may be transmitted by one or more screws disposed within the base unit 80 pressing the spherical cap mount 100 upwards against the spherical cap 70 of the arm 30.

In another embodiment of the invention (not shown) the arm 30 is extendable thereby providing an additional way of adjusting the direction of the airflow. The arm 30 is preferably of a telescoping type and provided with a locking mechanism for each segment of the telescoping arm.

In a preferred embodiment, the fan blower 10 includes a handle 20 coupled to the fan blower 10 by which the rotatable pivot mount may be adjusted and the airflow direction altered. It is preferable that the handle 20 does not significantly obstruct either the air intake or exhaust of the fan unit. Additionally, as shown in FIG. 1, the handle 20 should be positioned so that it will act as a lever when rotating the fan about the vertical axis and when pivoting the fan about the spherical cap 70 of the arm 30, thus reducing the amount of force required to overcome the friction force created within the rotatable pivot mount.

Another feature of this invention is that the pivot guide 60 of the top portion 50 of the base unit can act as a guide for positioning the arm 30 by preventing the fan from being adjusted to certain positions. If the fan blower 10 is pivoted too far off the vertical axis, the center of gravity may extend beyond the support area provided by the base unit 80. The shape of the opening 120 of the pivot guide 60 can be adjusted to prevent the fan blower 10 from pivoting such that the center of gravity extends beyond the support area provided by the base unit 80. If the base unit 80 is a circle, and the opening is located at the center of the base, then the opening 120 of the pivot guide 60 could be a circle having a particular radius to prevent the arm from pivoting too far. If the base unit 80 is in the shape of a triangular support, as shown in the embodiment in FIGS. 1-3, then the pivot guide 60 could be shaped so that the angle of rotation of the fan about the pivot would be greater when positioned over one of the ground supports than when positioned between two of the ground supports.

Another feature of this invention is that the pivot guide 60 of the top portion of the base unit can increase the stability of the fan when adjusted to certain positions. The friction created at the pivot should be sufficient to hold the fan in any position to which it is adjusted. However, if the frictional force should decrease through wear of the assembly or if a sudden external force is exerted on the assembly, the static friction may be overcome and the fan could be moved out of its adjusted position. The shape of the opening 120 of the pivot guide 60 can provide inlets 170 in which the arm 30 rests thus complementing the support provided by the frictional force exerted by the bottom potion 40 of the base unit 80. Thus, if the assembly is disturbed by an external force while the arm 30 is positioned in one of the inlets 170 provided by the pivot guide 60, the added stability of being positioned in the inlet 170 decreases the likelihood of the fan being moved out of position.

While the invention has been shown by way of reference to a rotatable pivot mount fan and particularly shown and described with reference to preferred embodiments thereof, it will be understood by those skilled in the art that the present invention may be utilized in any pivotable appliance and that various changes in form and details may be made therein without departing from the spirit and scope of the invention.

We claim:

1. A pivot assembly comprising:

an arm having a receiving end, a pivot end, and an axis defined by the receiving end and the pivot end, the pivot end including a spherical cap having an inner radius, an outer radius, and a diameter; and a base unit including a a bottom portion and a top portion having an opening smaller than the diameter of the spherical cap, wherein the base unit receives the pivot end of the arm and the arm extends away from the bottom portion of the base unit, the spherical cap of the pivot end of the arm being held between the bottom portion and the top portion, and the arm being rotatable so that the axis of the arm can be positioned at a selected orientation and the axis of the arm is angularly rotatable about the selected orientation.

2. The pivot assembly of claim 1, wherein the opening of the top portion is substantially flush with the outer surface of the spherical cap of the arm.

3. The pivot assembly of claim 1, wherein the bottom portion includes a spherical cap mount positioned against the inner surface of the spherical cap.

4. The pivot assembly of claim 3, wherein the spherical cap mount includes a spherical cap having an outer radius roughly equal to the inner radius of the spherical cap of the arm and the spherical cap of the spherical cap mount is positioned so that it is substantially flush with the inner surface of the spherical cap of the arm.

5. The pivot assembly of claim 1, wherein the bottom portion includes a coupling positioned to tightly hold the spherical cap of the arm between the bottom portion and the top portion.

6. The pivot assembly of claim 5, wherein the coupling includes a spring.

7. The pivot assembly of claim 3, wherein the spherical cap mount includes a threaded portion coupled to the bottom portion allowing the position of the spherical cap mount to be adjusted relative to the bottom portion.

8. The pivot assembly of claim 3, wherein the bottom portion further includes at least one screw that when rotated adjusts the vertical position of the spherical cap mount relative to the bottom portion of the base unit.

9. The pivot assembly of claim 1, wherein the top portion includes a pivot guide.

10. The pivot assembly of claim 9, wherein the base unit defines an area of support and the pivot guide prevents the center of gravity of the pivot assembly from extending beyond the area of support.

11. The pivot assembly of claim 9, wherein the pivot guide includes at least one stabilizing inlet.

12. The pivot assembly of claim 1, wherein the arm includes a telescoping arm.

13. The pivot assembly of claim 12, wherein the telescoping arm includes a plurality of segments and an extension locking mechanism for each of the plurality of segments.

14. The pivot assembly of claim 1, further comprising a heater unit coupled to the receiving end of the arm.

15. The pivot assembly of claim 1, further comprising a blower unit coupled to the receiving end of the arm.

16. The pivot assembly of claim 15, wherein the blower unit includes a handle coupled to the blower.

17. The pivot assembly of claim 16, wherein the handle is positioned to provide a lever for rotating the blower unit about the vertical axis and pivoting about the center of the spherical cap of the arm.

18. The pivot assembly of claim 15, wherein the blower unit is detachable from the arm.

19. A pivot assembly comprising:

a blower unit, an arm including a receiving end coupled to the blower unit, a pivot end, the pivot end including a spherical cap having an inner surface, an outer surface, and a diameter, and an axis defined by the receiving end and the pivot end; and a base unit including a bottom portion, a spherical cap mount including a spherical cap having an outer radius substantially equivalent to the inner radius of the spherical cap of the arm and substantially flush with the inner surface of the spherical cap of the arm, a pivot guide, and a top portion having an opening smaller than the diameter of the spherical cap of the arm, the opening being substantially flush with the outer surface of the spherical cap of the arm, wherein the base unit receives the pivot end of the arm and the arm extends away from the bottom portion of the base unit, the spherical cap of the pivot end of the arm being held between the bottom portion and the top portion, the spherical cap of the pivot end of the arm being rotatable so that the axis of the arm can be positioned at a selected orientation and the axis of the arm is angularly rotatable about the selected orientation.

* * * * *